US011475757B1

(12) United States Patent
Alessi et al.

(10) Patent No.: US 11,475,757 B1
(45) Date of Patent: Oct. 18, 2022

(54) CONTEXT-AWARE SYSTEM AND METHOD FOR IR SENSING

(71) Applicant: STMicroelectronics S.r.l., Agrate Brianza (IT)

(72) Inventors: Enrico Rosario Alessi, Catania (IT); Fabio Passaniti, Syracuse (IT)

(73) Assignee: STMicroelectronics S.r.l., Agrate Brianza (IT)

( * ) Notice: Subject to any disclaimer, the term of this patent is extended or adjusted under 35 U.S.C. 154(b) by 0 days.

(21) Appl. No.: 17/323,807

(22) Filed: May 18, 2021

(51) Int. Cl.
*G08B 25/00* (2006.01)
*G08B 13/19* (2006.01)

(52) U.S. Cl.
CPC ..... *G08B 25/001* (2013.01); *G08B 13/19* (2013.01); *G08B 25/007* (2013.01)

(58) Field of Classification Search
CPC ..... G08B 24/001; G08B 13/19; G08B 25/007
See application file for complete search history.

(56) References Cited

U.S. PATENT DOCUMENTS 4,442,359 A * 4/1984 Lederer ..... G08B 13/193 340/567
5,693,943 A * 12/1997 Tchernihovski ..... G08B 13/19 250/342
5,729,019 A * 3/1998 Krafthefer ..... G01J 5/08 250/353
9,697,539 B2 7/2017 Emigh et al.
10,127,782 B1 * 11/2018 Barth ..... G08B 13/19613
10,354,503 B1 * 7/2019 Kostrun ..... G08B 13/194
10,504,358 B2 12/2019 Sayavong et al.
10,530,406 B2 1/2020 Botchway et al.
10,539,439 B2 1/2020 Wilson
10,690,369 B2 6/2020 Matsuoka et al.
10,803,717 B2 * 10/2020 Ashar ..... H04W 84/18
10,847,009 B1 * 11/2020 Sulucz ..... G08B 17/125
10,902,268 B2 1/2021 Kaestle et al.
10,909,826 B1 * 2/2021 Solh ..... G08B 21/0423
(Continued)

OTHER PUBLICATIONS

Farid, Zahid, et al., "Recent Advances in Wireless Indoor Localization Techniques and System", Hindawi Publishing Corporation, vol. 2013, Article ID 185138, http://dx.doi.org/10.1155/2013/185138, Journal of Computer Networks and Communications, May 17, 2013, 13 pages.
Hauschildt, Daniel, et al., "Advances in Thermal Infrared Localization: Challenges and Solutions," 2010 International Conference on Indoor Positioning and Indoor Navigation (IPIN), Sep. 15-17, 2010, 8 pages.
(Continued)

*Primary Examiner* — Ojiako K Nwugo
(74) *Attorney, Agent, or Firm* — Slater Matsil, LLP

(57) ABSTRACT

A method includes: receiving IR radiation with a plurality of IR sensors; producing a plurality of output signals with the plurality of IR sensors based on the received IR radiation, where each of the plurality of output signals is indicative of an intensity of the IR radiation received by a respective IR sensor of the plurality of IR sensors; detecting an IR source based on the plurality of output signals; generating a candidate alarm in response to detecting the IR source; determining whether the detected IR source matches any reference IR source of a set of reference IR sources; when the detected IR source matches one reference IR source of the set of reference IR sources, issuing a user alarm, and when the detected IR source does not match any reference IR source of the set of reference IR sources, canceling the candidate alarm without issuing the user alarm.

27 Claims, 8 Drawing Sheets

(56) References Cited

U.S. PATENT DOCUMENTS

| | | | | |
|---|---|---|---|---|
| 10,922,940 | B1 * | 2/2021 | Chin | G08B 13/19695 |
| 2007/0187605 | A1 * | 8/2007 | Micko | G01J 5/0808 250/339.04 |
| 2007/0291115 | A1 * | 12/2007 | Bachelder | H04N 7/185 348/E7.086 |
| 2009/0014654 | A1 * | 1/2009 | Zhevelev | G08B 13/193 250/339.02 |
| 2009/0302222 | A1 * | 12/2009 | Zhevelev | G01J 5/0893 250/353 |
| 2011/0006897 | A1 * | 1/2011 | Micko | G08B 13/191 340/565 |
| 2013/0107245 | A1 * | 5/2013 | Covaro | G08B 13/191 356/51 |
| 2014/0326888 | A1 * | 11/2014 | Barlow | G01S 5/16 250/342 |
| 2018/0039745 | A1 * | 2/2018 | Chevalier | G16H 40/63 |
| 2019/0073883 | A1 | 3/2019 | Hoang et al. | |
| 2019/0228624 | A1 * | 7/2019 | Kostrun | G08B 13/1895 |
| 2019/0281262 | A1 * | 9/2019 | Ryan | G06V 10/143 |
| 2020/0294382 | A1 * | 9/2020 | Pradhan | G08B 21/22 |
| 2020/0379140 | A1 * | 12/2020 | Kostrun | G01V 8/10 |
| 2021/0245738 | A1 * | 8/2021 | Mueller | G06V 20/582 |

OTHER PUBLICATIONS

Jain, Anil K., et al., "Statistical Pattern Recognition: A Review", IEEE Transactions on Pattern Analysis and Machine Intelligence, vol. 22, No. 1, Jan. 2000, 34 pages.

Kim, Wooyoung, et al., "On Target Tracking with Binary Proximity Sensors", Apr. 25-27, 2005, Proceedings of the Fourth International Symposium on Information Processing in Sensor Networks, IEEE, 8 pages.

Lai, Kuan-Chung, et al., "Using Cooperative PIR Sensing for Human Indoor Localization," The 27th Wireless and Dptical Communications Conference (WOCC2018), Apr. 30, 2018, 5 pages.

Moisello, Elisabetta, et al., "An Integrated Thermopile-Based Sensor with a Chopper-Stabilized Interface Circuit for Presence Detection", Sensors, MDPI, www.mdpi.com/journal/sensors, Aug. 22, 2019, 19 pages.

Moshe, Avraham, et al., "Wafer-Level Packaged CMOS-SOI-MEMS Thermal Sensor at Wide Pressure Range for IoT Applications", Engineering Proceedings, MDPI, www.mdpi.com/journal/engproc, Nov. 14, 2020, 7 pages.

Yiyang, Zhao, et al., "VIRE: Active RFID-based Localization Using Virtual Reference Elimination", Department of Computer Science and Engineering The Hong Kong University of Science and Technology, Hong Kong, Oct. 15, 2007, 8 pages.

* cited by examiner

500

| Known IR source | Features (Identifiers) | | | | | | | | |
|---|---|---|---|---|---|---|---|---|---|
| | IR source location | Location variation | Initial IR strentgh | Final IR strength | Transient time $t_f$ | Transient shape | Ripple | Time of day (turn on) | Time of day (turn off) |
| 1 | $\vec{V}_{rel1}$ | $\frac{\partial \vec{V}_{rel1}}{\partial t}$ | $\lvert\vec{V}_{rel1}\rvert_{init}$ | $\lvert\vec{V}_{rel1}\rvert_{end}$ | $t_{f_1}$ | $S_1(t)$ | $R_1$ | $TDon_1$ | $TDoff_1$ |
| 2 | $\vec{V}_{rel2}$ | $\frac{\partial \vec{V}_{rel2}}{\partial t}$ | $\lvert\vec{V}_{rel2}\rvert_{init}$ | $\lvert\vec{V}_{rel2}\rvert_{end}$ | $t_{f_2}$ | $S_2(t)$ | $R_2$ | $TDon_2$ | $TDoff_2$ |
| ⋮ | ⋮ | ⋮ | ⋮ | ⋮ | ⋮ | ⋮ | ⋮ | ⋮ | ⋮ |
| $N$ | $\vec{V}_{relN}$ | $\frac{\partial \vec{V}_{relN}}{\partial t}$ | $\lvert\vec{V}_{relN}\rvert_{init}$ | $\lvert\vec{V}_{relN}\rvert_{end}$ | $t_{f_N}$ | $S_N(t)$ | $R_N$ | $TDon_N$ | $TDoff_N$ |

FIG. 5

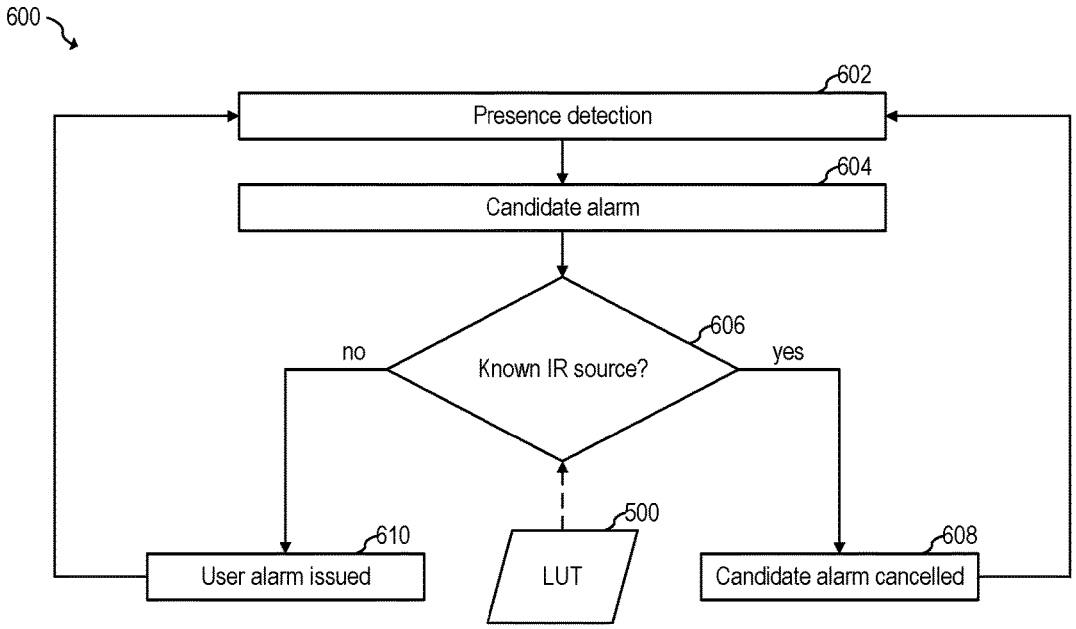

FIG. 6

CONTEXT-AWARE SYSTEM AND METHOD FOR IR SENSING

TECHNICAL FIELD

The present disclosure relates generally to an electronic system and method, and, in particular embodiments, to a context-aware system and method for infrared (IR) sensing.

BACKGROUND

Presence detection and localization systems may be beneficial in a variety of applications, such as intruder monitoring and detection, and smart building management. For example, intruder detection may rely on presence detection sensors for monitoring homes and other facilities. Building management applications may rely on presence detection sensors to determine when to activate or deactivate lights, HVAC systems, doors, etc.

Presence detection and localization systems may us an active emitter/transceiver, such as systems relying on radio-frequency (RF) identification (RFID), radio, ultrasound, or may be implemented as a passive system, such as camera-based systems and thermal-based systems.

Thermal-based sensors may sense the heat, e.g., of the skin of a human, and, thus, may be used for human presence detection and/or human localization. Thermal-based sensors include pyroelectric infrared (PIR) sensors, microbolometer arrays, and thermopiles.

PIR sensors detect changes in heat flow in their field-of-view (FoV). For example, when a hot body enters the FoV of a PIR sensor, the PIR sensor generates a pulse. When the hot body leaves the FoV of the PIR sensor, the PIR sensor generates another (e.g., inverted) pulse.

Microbolometer arrays include an array of pixel in which each pixel changes its resistivity based on the received IR radiation. Thus, an IR image may be generated based on the magnitude of change in the resistivity of each pixel. IR cameras may be implemented with microbolometer arrays.

Thermopiles may be implemented with series-connected thermocouples and generate a voltage based on the difference between the IR radiation of objects in its FoV and IR radiation from the ambient.

SUMMARY

In accordance with an embodiment, a method includes: receiving IR radiation with a plurality of IR sensors having a plurality of respective field-of-views; producing a plurality of output signals with the plurality of IR sensors based on the received IR radiation, where each of the plurality of output signals is indicative of an intensity of the IR radiation received by a respective IR sensor of the plurality of IR sensors; detecting an IR source based on the plurality of output signals; generating a candidate alarm in response to detecting the IR source; determining whether the detected IR source matches any reference IR source of a set of reference IR sources; when the detected IR source matches one reference IR source of the set of reference IR sources, issuing a user alarm, and when the detected IR source does not match any reference IR source of the set of reference IR sources, canceling the candidate alarm without issuing the user alarm.

In accordance with an embodiment, an IR sensing system includes: a plurality of IR sensors having a plurality of respective field-of-views, each IR sensor of the plurality of IR sensors configured to produce a respective output signal based on IR radiation received from the respective field-of-view; and a controller configured to: detect an IR source based on one or more output signals of the plurality of IR sensors, generate a candidate alarm in response to detecting the IR source, determine whether the detected IR source matches any reference IR source of a set of reference IR sources, when the detected IR source matches one reference IR source of the set of reference IR sources, issue a user alarm, and when the detected IR source does not match any reference IR source of the set of reference IR sources, cancel the candidate alarm without issuing the user alarm.

In accordance with an embodiment, a method includes: receiving IR radiation with a plurality of IR sensors having a plurality of respective field-of-views; producing a plurality of output signals based on the received IR radiation, where each of the plurality of output signals is indicative of an intensity of the IR radiation received by a respective IR sensor of the plurality of IR sensors; detecting a candidate IR source based on the plurality of output signals when each relative change with, respect to time, in IR strength from the plurality of IR sensors is higher than a predetermined threshold; after detecting the candidate IR source, checking whether identifiers of the candidate IR source match corresponding identifiers of any record of a look-up table (LUT) within a first set of respective tolerances; when the identifiers of the candidate IR source do not match the corresponding identifiers of any record of the LUT within the first set of respective tolerances, checking whether the identifiers of the candidate IR source match corresponding identifiers of any record of the LUT within a second set of respective tolerances, and checking whether the identifiers of the candidate IR source match corresponding aggregated identifiers of aggregated records of the LUT within a third set of respective tolerances; and when the identifiers of the candidate IR source match corresponding identifiers of a first record of the LUT within the second set of respective tolerances or when the identifiers of the candidate IR source match corresponding aggregated identifiers of a first aggregated record of the LUT within the third set of respective tolerances, adding a record to the LUT with a set of identifiers corresponding to the candidate IR source.

BRIEF DESCRIPTION OF THE DRAWINGS

For a more complete understanding of the present invention, and the advantages thereof, reference is now made to the following descriptions taken in conjunction with the accompanying drawings, in which:

FIG. 5 shows a look-up table (LUT) for storing features of known IR sources, according to an embodiment of the present invention;

FIG. 6 shows a flow chart of an embodiment method for a context-aware presence detection, according to an embodiment of the present invention;

Corresponding numerals and symbols in different figures generally refer to corresponding parts unless otherwise indicated. The figures are drawn to clearly illustrate the relevant aspects of the preferred embodiments and are not necessarily drawn to scale.

DETAILED DESCRIPTION OF ILLUSTRATIVE EMBODIMENTS

Figure 1A:
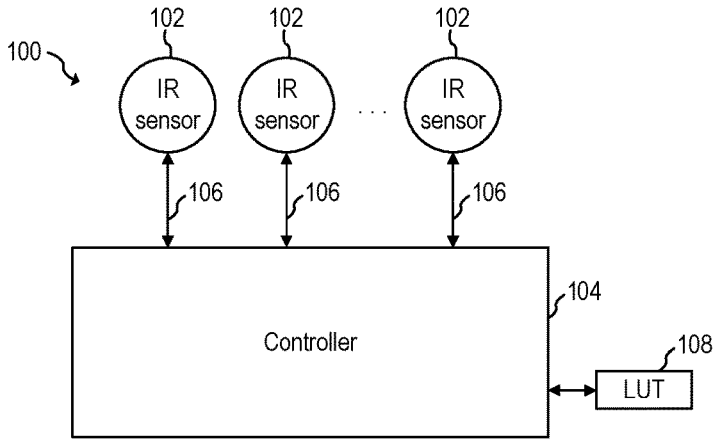
FIG. 1A shows an infrared (IR) sensing system, according to embodiments of the present invention.

The making and using of the embodiments disclosed are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

The description below illustrates the various specific details to provide an in-depth understanding of several example embodiments according to the description. The embodiments may be obtained without one or more of the specific details, or with other methods, components, materials and the like. In other cases, known structures, materials or operations are not shown or described in detail so as not to obscure the different aspects of the embodiments. References to "an embodiment" in this description indicate that a particular configuration, structure or feature described in relation to the embodiment is included in at least one embodiment. Consequently, phrases such as "in one embodiment" that may appear at different points of the present description do not necessarily refer exactly to the same embodiment. Furthermore, specific formations, structures or features may be combined in any appropriate manner in one or more embodiments.

Embodiments of the present invention will be described in a specific context, a context aware method for IR sensing, e.g., such as for presence detection or for indoor localization, e.g., using thermopile-based sensors. Some embodiments may use other types of sensors different from thermopiles sensors, such as pyroelectric, photodiodes, bolometers, and microbolometers, for example. Some embodiments may be used outdoors.

In an embodiment of the present invention, a plurality of IR sensors of an IR sensing system cooperate to detect foreign IR sources in an indoor environment and to issue an alarm when a foreign IR source is detected. The IR sensing system is context-aware and ignores (does not issue an alarm) known IR sources. In some embodiments, the known IR sources are identified based on a plurality of features, such as IR source location, IR strength, and the time it takes for the IR source to reach steady state (e.g., turn fully on, such as when the IR radiation is within a predetermined tolerance, such as varying less than 1%). In some embodiments, detecting known IR sources advantageously allows for the avoidance (or reduction) of false positives in a presence detection system.

In some embodiments, the IR sensing system self-learns the context (e.g., the IR sources) of the indoor environment with the evolution of time. In some embodiments, actively learning the context of an indoor environment (e.g., during runtime) advantageously allows the IR sensing system to adapt to changes in the indoor environment, which may advantageously allow for the IR sensing system to operate optimally in detecting foreign IR sources while avoiding the issuance of alarms when known IR sources are activated, active, or deactivated.

IR-based presence detection may detect a plurality of IR sources that are activated, active, or deactivated, in an indoor environment. Examples of IR sources that may be detected include humans, dogs, light bulbs, heaters, televisions, drones, and any other IR emitting object.

Some IR sources may be part of the environment. For example, a ceiling light may be part of the indoor environment. Similarly, a window, a television, and a heater, may be IR sources that are part of an indoor environment. Known IR sources that are part of the environment may be referred to as interfering IR sources (e.g., since the IR radiation produced by such IR sources interferes with the detection of foreign IR sources).

In some embodiments, known IR sources of an indoor environment are identified, and the activation, deactivation, or continuous IR radiation of known IR sources, do not trigger an alarm, while the activation, deactivation or continuous IR radiation of foreign IR sources (IR sources that are not part of the indoor environment) in the indoor environment do trigger an alarm.

FIG. 1A shows IR sensing system wo, according to an embodiment of the present invention. IR sensing system 100 includes a plurality of IR sensors 102 and controller 104. IR sensing system wo may be implemented, e.g., in an indoor environment, such as in a bedroom or living room, for example.

During normal operation, IR sensors 102 detect IR radiation in their respective field-of-views (FoVs). Information about the detected IR radiation (e.g., intensity, timing) by the plurality of IR sensors 102 is transmitted to controller 104. Controller 104 then determines possible locations of the source(s) of the IR radiation, and determines whether to ignore the detection (e.g., when the IR source is part of the environment, such as a ceiling light in a room), or to alert a user about a presence detection (e.g., when the IR source is foreign to the environment).

IR sensor 102 is configured to generate a (e.g., continuous) signal (e.g., a voltage) with an intensity that is based on the intensity of IR radiation received. For example, in some embodiments, IR sensor 102 produces a higher output voltage when an IR source producing a fixed IR radiation is located closer to IR sensor 102 (e.g., less than 1 m) than when it is located farther from IR sensor 102 (e.g., at 2.5 m). In some embodiments, IR sensor 102 may produce the same output voltage for two (e.g., identical) IR sources located at the same distance from IR source 102 (e.g., at 1 m) but at different angles. In some embodiments, IR sensor 102 may produce the same output voltage for two IR sources located at different distance from IR source 102, in which the IR source closer to IR sensor 102 produces weaker IR radiation than the IR source that is further from IR sensor 102.

IR sensor 102 may be implemented, e.g., with a thermopile. For example, in some embodiments, the thermopiles may be integrated in an integrated circuit (IC), such as when using thermal metal-oxide semiconductor (TMOS). Other IR sensors, such as IR sensors based on a microbolometer, may also be used.

In some embodiments, the range of IR sensor 102 may be, e.g., 6 m. A different range, such as lower than 6 m (e.g., 5 m or lower) or longer than 6 m (e.g., 7 m or higher) may also be used.

In some embodiments, the plurality of IR sensors 102 may each have the same range. In some embodiments, some or all of the IR sensors 102 of the plurality of IR sensors 102 may have different range.

In some embodiments, IR sensor 102 may include a lens. Different types of lenses may be used, e.g., to adjust the FoV or the detection range, for example. In some embodiments, IR sensor 102 may operate without a lens.

In some embodiments, the plurality of IR sensors 102 may each have the same lens configuration (e.g., all without lens, or all with the same type of lens). In some embodiments, some or all of the IR sensors 102 of the plurality of IR sensors 102 may have different lens configuration.

In some embodiments, the FoV of IR sensor 102 is between 70° and 90°, such as 80°. A different FoV, such as lower than 70° (e.g., 50° or lower), or higher than 90° (e.g., 100° or higher) may also be possible.

In some embodiments, the plurality of IR sensors 102 may each have the same FoV. In some embodiments, some or all of the IR sensors 102 of the plurality of IR sensors 102 may have different FoV.

The plurality of IR sensors 102 may be located at different locations in the indoor environment, such as in each corner of a room. In some embodiments, the plurality of IR sensors 102 may include 3 or more IR sensors 102.

Controller 104 may be implemented with a general purpose or custom controller or processor, such as a digital signal processor (DSP), which includes, for example, combinatorial circuits coupled to a memory. For example, in some embodiments, controller 104 may be implemented with an ARM, RISC, or x86 architecture. Other implementations are also possible.

In some embodiments, controller 104 may determine a location of an IR source by using trilateration, for example. In some embodiments, controller 104 uses a signature of the IR source (e.g., the IR intensity, the time it takes to turn on/off, the time of the day/week in which the IR source turns on/off, etc.) to determine whether the source is part of the environment.

In some embodiments, controller 104 may be implemented separate from the plurality of IR sensors 102. For example, in some embodiments, controller 104 may be implemented with a microcontroller that is external to IR sensors 102. In other embodiments, one of the plurality of IR sensors 102 may implement controller 104 (e.g., using controller 114). In some embodiments, each of the plurality of IR sensors 102 implements at least a portion of controller 104 (e.g., implemented by controller 114), with the rest of controller 104 being implemented in one of the IR sensors 102 or as a standalone controller. Other implementations are also possible.

Communication link 106 is used for the IR sensors 102 to transmit data to controller 104. For example, in some embodiments, the data transmitted by an IR sensor 102 includes data indicative of the output signal (e.g., output voltage) of the IR sensor 102.

In some embodiments, communication link 106 is used to configure IR sensors 102. Communication link 106 may be wired or wireless. For example, in some embodiments, communication link 106 may be implemented with WiFi or Bluetooth. Other implementations are also possible.

Look-up table (LUT) 108 may be used to store signatures of known IR sources that controller 104 may use to determine whether an IR source is part to the environment (and thus avoid triggering of an alarm as a result of the presence detection) or it is not (thus triggering an alarm as a result of the presence detection). LUT 108 may be implemented, e.g., in a non-volatile memory coupled to controller 104. In some embodiments, LUT 108 may be part of controller 104.

Figure 1B:
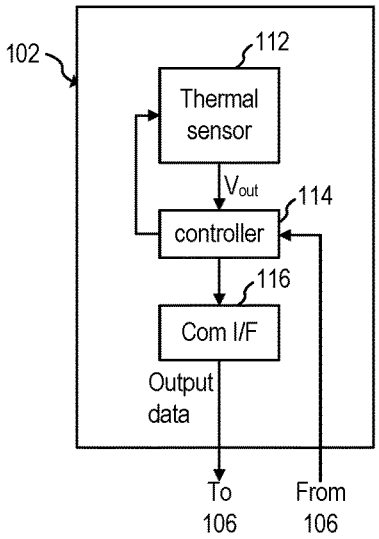
FIG. 1B shows a possible implementation of an IR sensor of FIG. 1A, according to an embodiment of the present invention.

FIG. 1B shows a possible implementation of IR sensor 102, according to an embodiment of the present invention. As shown in FIG. 1B, IR sensor 102 may include thermal sensor 112, controller 114, and communication interface 116.

During normal operation, thermal sensor 112 produces output voltage $V_{out}$ based on the amount of IR radiation received by the thermal sensor. For example, in some embodiments, the output voltage $V_{out}$ is proportional to the amount of IR radiation received by the thermal sensor.

Controller 114 receives output voltage $V_{out}$ and generates (e.g., digital) data based on the output voltage $V_{out}$. For example, in some embodiments, controller 114 includes an analog-to-digital converter (ADC) for generating a digital representation of the output voltage $V_{out}$. The data generated by controller 114 is transmitted by communication interface 116 to controller 104 for further processing.

In some embodiments, thermal sensor 112 may include a thermopile. Other thermal sensors, such as a microbolometer, may also be used.

Controller 114 may be implemented with a general purpose or custom controller or processor, such as a digital signal processor (DSP), which includes, for example, combinatorial circuits coupled to a memory. For example, in some embodiments, controller 104 may be implemented with an ARM, RISC, or x86 architecture. Other implementations are also possible.

Communication interface 116 may be implemented as a wired communication interface. For example, in some embodiments, communication interface 116 may be implemented as an inter-integrated Circuit (I2C) interface, serial peripheral interface (SPI), universal serial bus (USB) interface, or inter-IC sound bus (I2S) interface, for example. Other wired communication interfaces known in the art may also be used.

Communication interface 116 may be implemented as a wireless communication interface. For example, in some embodiments, communication interface 116 may be implemented as WiFi interface or Bluetooth interface. Other wireless communication interfaces known in the art may also be used.

In some embodiments, IR sensor 102 transmits output voltage $V_{out}$ directly to controller 104 (e.g., where controller 104 may use an ADC to converter the output voltage $V_{out}$ to digital form). In some such embodiments, controller 114 and communication interface 116 may be omitted.

Figure 2:
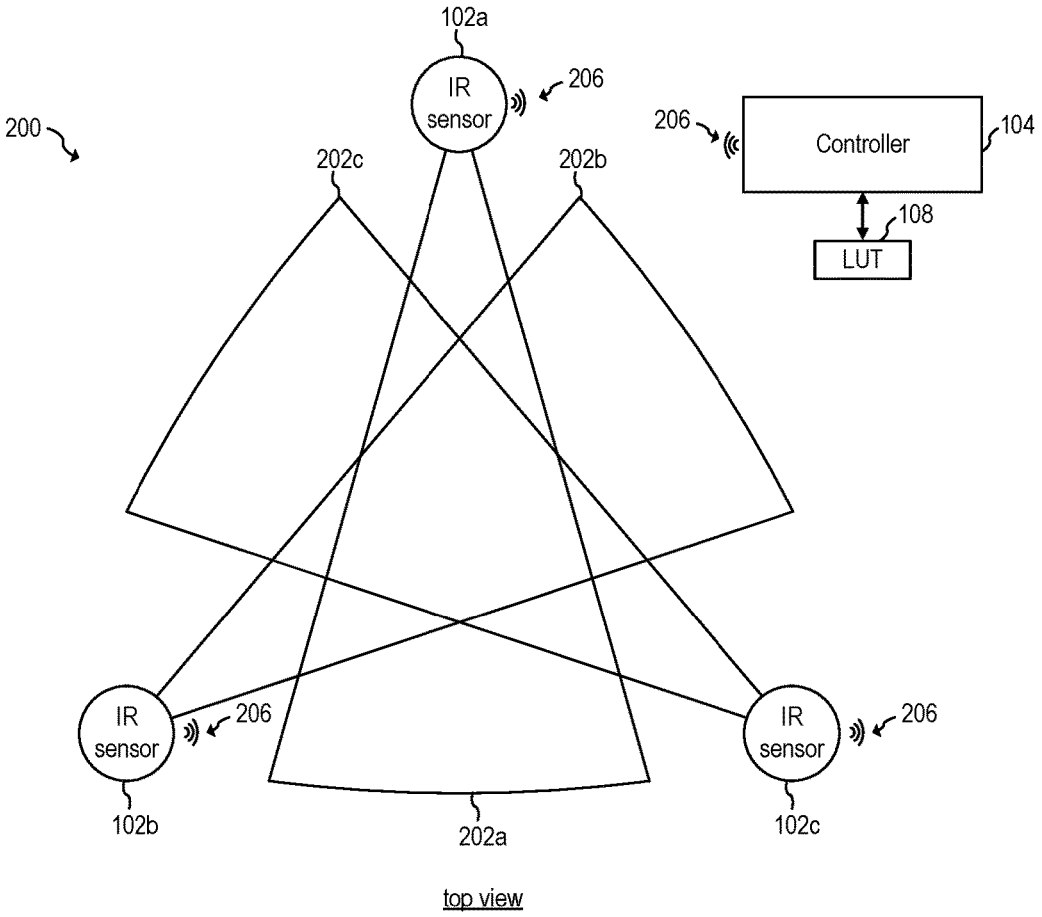
FIG. 2 shows an IR sensing system, according to embodiments of the present invention.

FIG. 2 shows IR sensing system 200, according to an embodiment of the present invention. IR sensing system wo may be implemented as IR sensing system 200. IR sensing system 200 includes 3 IR sensors 102 and controller 104 having a wireless communication link 206.

As shown in FIG. 2, each of the IR sensors 102 is at a different location of an (e.g., indoor) environment, and having a respective FoV 202 at least partially overlapping with at least another FoV 202. For example, as shown in FIG. 2, FoV 202*a*, 202*b*, and 202*c*, respectively associated with IR sensors 102*a*, 102*b*, and 102*c*, overlap with each other.

Figure 3B:
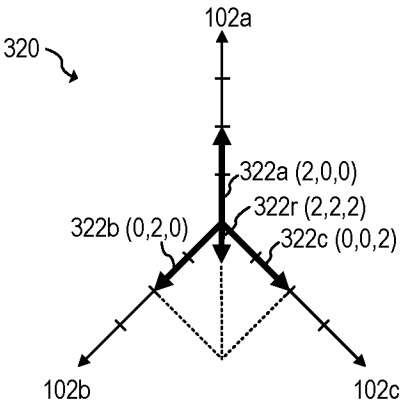
FIGS. 3A and 3B show an IR source located equidistant to the IR sensors of FIG. 2, and an associated vector representation, respectively, according to an embodiment of the present invention.
Figure 3A:
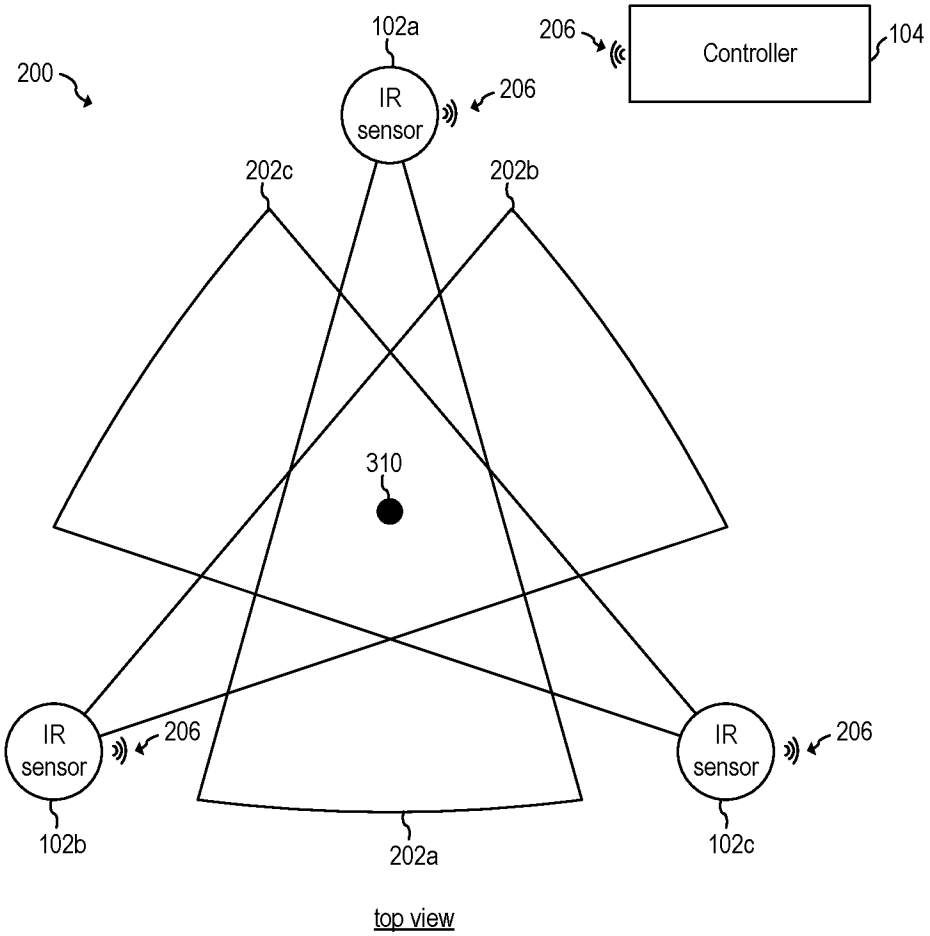

During normal operation, when there is no IR source present in the environment, the output of all IR sensors 102 may be equal and may be indicative of the ambient IR intensity. When a single IR source is equidistant to all IR sensors 102, then the output of each IR sensor 102 may be the same, but having an intensity higher than that of the ambient IR intensity. For example, FIGS. 3A and 3B show IR source 310 located equidistant to IR sensor 102*a*, 102*b* and 102*c*, and associated vector representation 32*o*, respectively, according to an embodiment of the present invention. Vector representation 320 includes an axis for each of IR sensors 102*a*, 102*b*, and 102*c*. Vectors 322*a*, 322*b*, and 322*c* are indicative of the IR signal strength received by IR sensors 102*a*, 102*b*, and 102*c*, respectively, when steady state is reached.

As shown in FIG. 3B, the IR signal strength received by each of IR sensors 102*a*, 102*b*, and 102*c*, is the same (in this example, illustrated with a magnitude of 2). Thus, the resulting vector 322*r* has the same coordinates in each dimension. In the example of FIGS. 3A and 3B, vector 322*r* has coordinates (2,2,2).

Figure 3D:
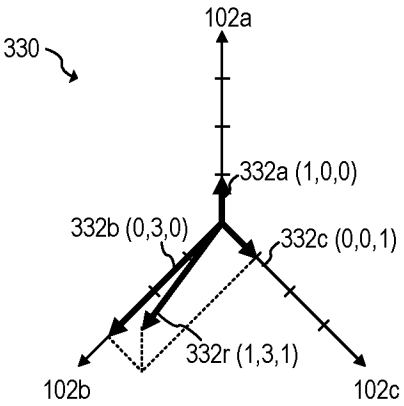
FIGS. 3C and 3D show an IR source located equidistant to two IR sensors of FIG. 2 but not the third IR sensor of FIG. 2, and associated vector representation, respectively, according to an embodiment of the present invention.
Figure 3C:
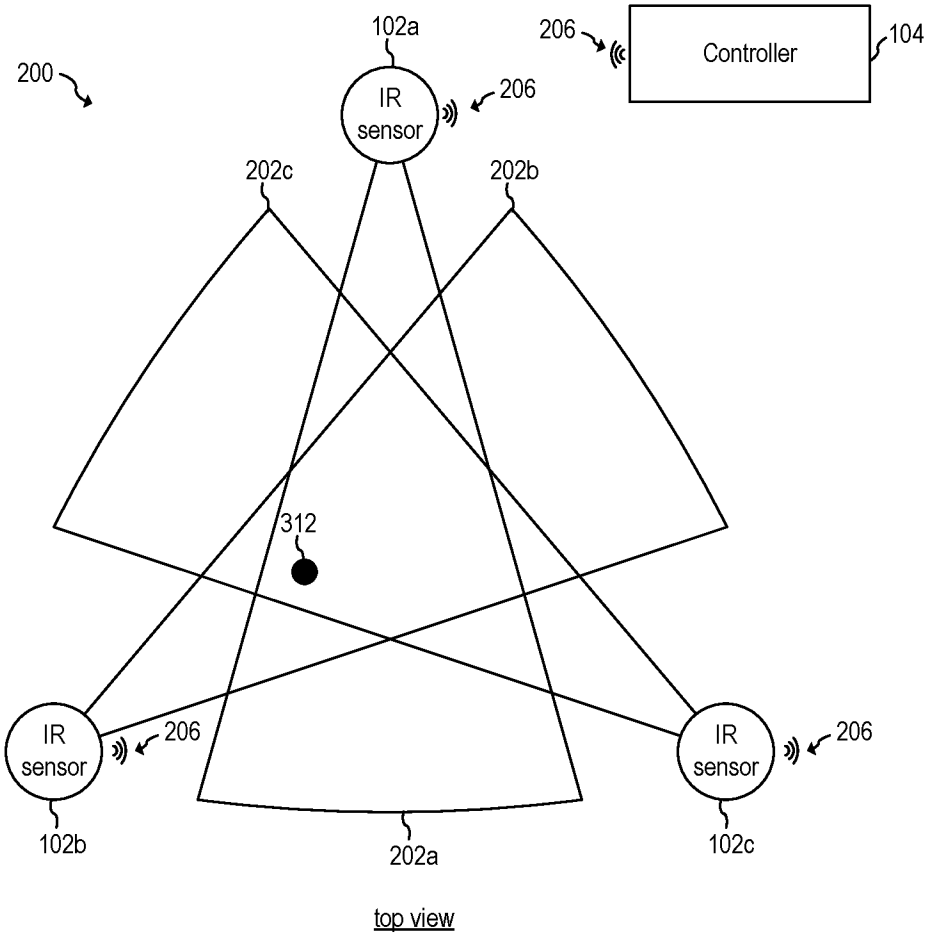

IR sources at different locations may produce different resulting vectors. For example, FIGS. 3C and 3D show IR source 312 located equidistant to IR sensor 102*a*, and 102*c*, but not 102*b*, and associated vector representation 330, respectively, according to an embodiment of the present invention. Vector representation 330 includes an axis for each of IR sensors 102*a*, 102*b*, and 102*c*. Vectors 332*a*, 332*b*, and 332*c* are indicative of the IR signal strength received by IR sensors 102*a*, 102*b*, and 102*c*, respectively, when steady state is reached.

As shown in FIG. 3D, the IR signal strength received by each of IR sensors 102*a* and 102*c* is the same (in this example, illustrated with a magnitude of 1). However, the signal strength received by IR sensor 102*b* is stronger than the signal strength received by IR sensors 102*a* and 102*c* (in this example, illustrated with a magnitude of 3). Thus, the resulting vector 332*r* has the same coordinates for two of the dimensions, but not the third. In the example of FIGS. 3C and 3D, vector 332*r* has coordinates (1,3,1).

Figure 3F:
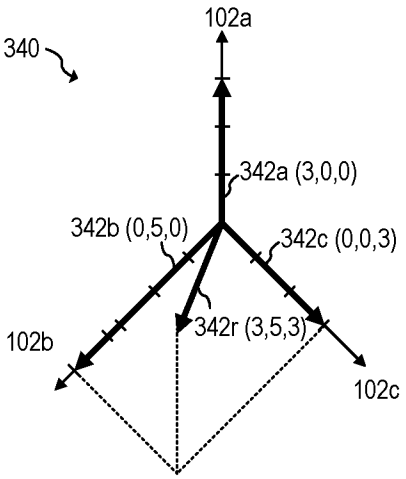
FIGS. 3E and 3F show the IR sources of FIGS. 3A and 3C and an associated vector representation, respectively, according to an embodiment of the present invention.
Figure 3E:
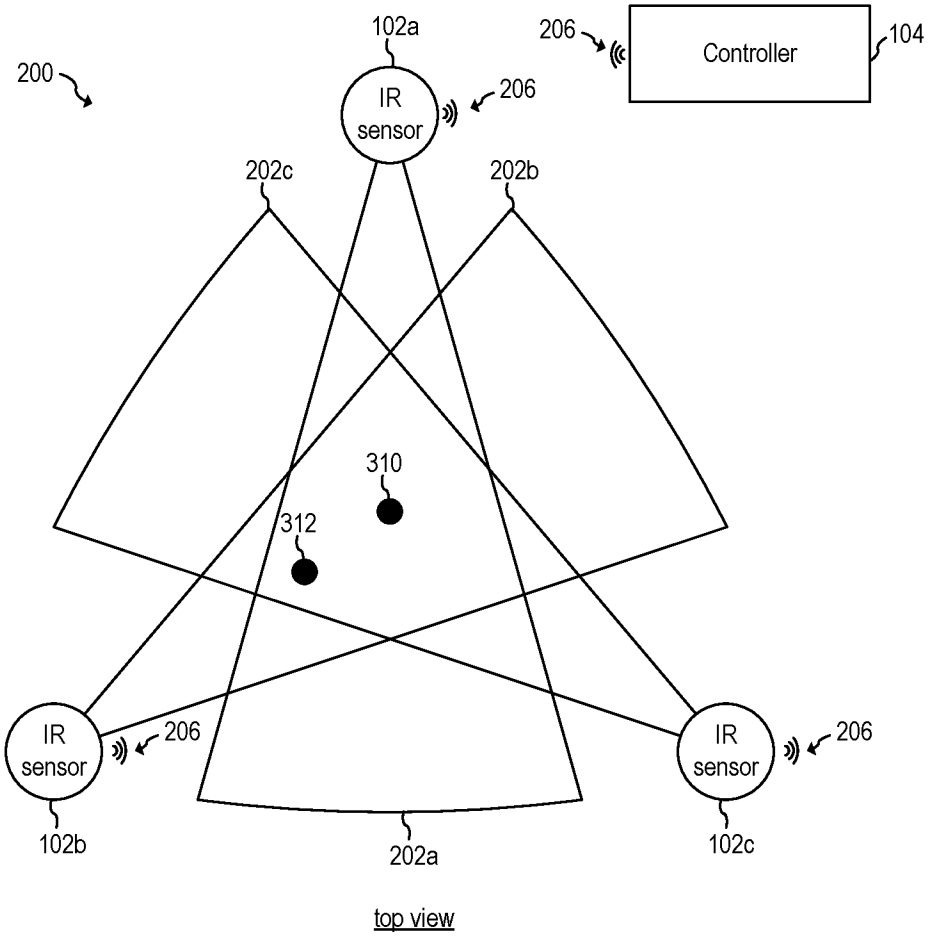

When more than one IR source is present in an environment, the plurality of IR sources may be modeled as a single IR source radiating the aggregate IR energy from the more than one IR sources. Thus, in some embodiments, modeling more than one IR source as a single IR source may result in a (e.g., single) resulting vector based on the (e.g., aggregate) resulting vectors of each IR source. For example, FIGS. 3E and 3F show IR source 310 and 312 and associated vector representation 340, respectively, according to an embodiment of the present invention. Vector representation 340 includes an axis for each of IR sensors 102*a*, 102*b*, and 102*c*. Vectors 342*a*, 342*b*, and 342*c* are indicative of the IR signal strength received by IR sensors 102*a*, 102*b*, and 102*c*, respectively, when steady state is reached.

As illustrated by FIG. 3F, the presence of IR sources 310 and 312 may be modeled as a single IR source and may be represented with a single vector 342*r* having magnitude and direction based on vectors 322*r* and 332*r* associated with IR sources 310 and 312, respectively. For example, in some embodiments, the vector 342*r* resulting when IR sources 310 and 312 are active and in steady state may be the sum of the vectors 322*r* and 332*r*. In this example, vector 342*r* is equal to (3,5,3), which is the sum of vectors 322 (2,2,2), and 332 (1,3,1).

In some embodiments, the resulting vector (e.g., 342*r*) including the aggregate of vectors for each IR source present in the environment (e.g., 322*r* and 332*r*) may be the same in steady state regardless of whether the IR sources (e.g., 310 and 312) are activated simultaneously, or one is activated after the other. However, other characteristics, such as initial IR intensity (also referred to as initial IR strength), and the transient time $t_f$ may be different based on when the IR sources are activated or deactivated.

As illustrated by FIGS. 3A-3D, the location of an IR source may be inferred by the strength of the signal received by each IR sensor 102, e.g., using trilateration. As illustrated by FIGS. 3E and 3F, multiple IR sources may be modeled as a single IR source. In some embodiments, IR sensing system 200 may also monitor the transient times of one or more IR sources. For example, when a light turns on, the initial IR radiation produced by the light may be initially low, and may gradually increase until reaching steady state. For example, FIGS. 4A-4E illustrate the progression in time of vector 332*r* as IR source 312 of FIG. 3C turns on, according to an embodiment of the present invention.

Figure 4A:
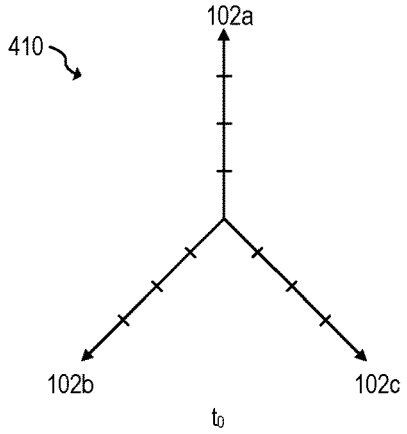
FIGS. 4A-4E illustrate the progression in time of the resulting vector of FIG. 3D as the IR source of FIG. 3C turns on, according to an embodiment of the present invention.

FIGS. 4A-4E illustrate relative vector magnitudes $V_{rel}$ (e.g., relative to ambient IR intensity) as opposed to absolute vector magnitudes $V_{abs}$ (e.g., actual IR intensities detected by the IR sensors, which may include ambient IR intensity). Thus, when no IR source is present in the environment (e.g., as shown in FIG. 4A), the magnitudes of the vector may be 0.

Figure 4B:
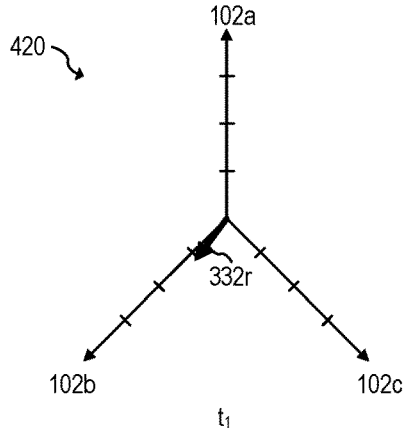
Figure 4C:
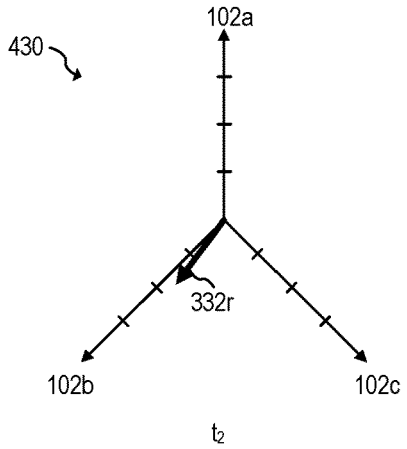
Figure 4D:
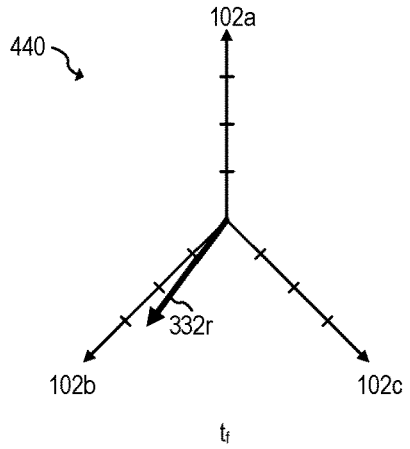
Figure 4E:
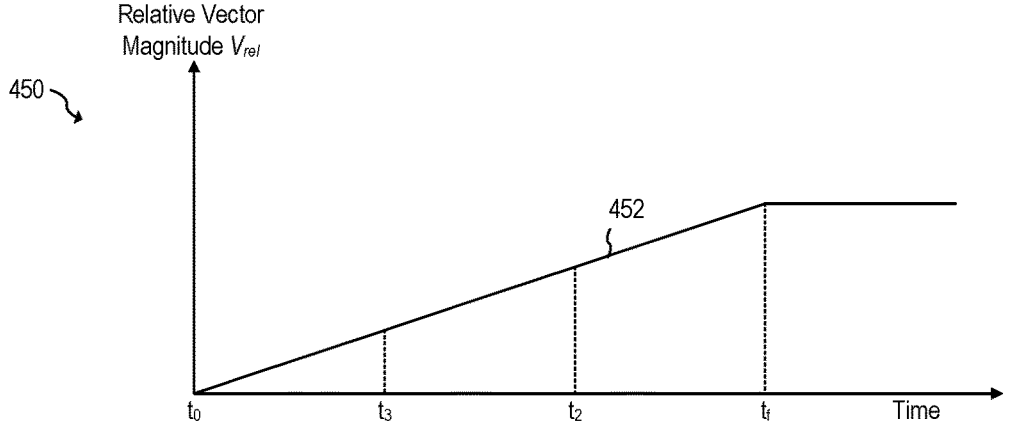

As shown by FIGS. 4A and 4E, at time $t_0$ when IR source 312 transitions from the off state to the on state, none of the IR sensors 102*a*, 102*b*, and 102*c* receives IR radiation, and thus, vector 332*r* has coordinates (0,0,0). As time progresses, IR source 312 radiates increasing amounts of IR energy, which is received by IR sensors 102*a*, 102*b*, and 102*c*, and thus, the magnitude of vector 332 progressively increases until reaching steady state at time $t_f$, as illustrated by FIGS. 4A-4E. In some embodiments, after time $t_f$, the magnitude of vector 332*r* does not change unless IR source 312 changes intensity/location or a new IR source is introduced into the FoV 202*a*, 202*b*, or 202*c*.

As shown by FIGS. 4B-4D, the direction of vector 332*r* does not change with time since the location of IR source 312 remains the same. However, different IR sources may take different amounts of time to reach steady state. For example, a heater may take longer (e.g., minutes) for reaching steady state than a light bulb (e.g., which may take about 5 seconds). In some embodiments, a particular IR source (e.g., a ceiling light) may be identified by the vector direction (which may be indicative of IR source location), vector magnitude (which may be indicative of IR energy radiated by the IR source), and transient time $t_f$.

As shown by curve 452, the transient magnitude of vector 332*r* may increase linearly with time until reaching time $t_f$. In some embodiments, the transient magnitude of vector 332*r* may increase non-linearly (e.g., exponentially) with time. In some embodiments, a particular IR source (e.g., a ceiling light) may be identified based on the shape of the transient magnitude of vector 332*r*. For example, in some embodiments, a particular IR source (e.g., a ceiling light) may be identified by a vector direction, vector magnitude, transient time $t_f$, and the shape of transient magnitude (which may be specific to a particular type of IR source, such as a particular model of light bulb).

In some embodiments, an IR source begins and stops radiating IR energy at predictable times of the day. For example, a window facing east may radiate IR energy from sunrise until noon. Thus, in some embodiments, a particular IR source (e.g., a window) may be identified based on the time of the day that it turns on and off. For example, in some embodiments, a particular IR source (e.g., a window) may be identified by a vector direction, vector magnitude, transient time $t_f$, and time of the day in which it turns on and off. In some embodiments, the time of the day may be a fixed time (e.g., 6:00 pm). In some embodiments, the time of the day may be a relative time (e.g., sunrise time, or sunset time).

In some embodiments, an IR source may exhibit ripple in steady state. For example, the IR radiation of a window may vary based on presence of clouds and the time of the day. As another example, a television may radiate varying amounts of IR energy depending on the number, color, and intensity of pixels activated at a particular time. Thus, in some embodiments, a ripple (e.g., the magnitude of the variation of IR intensity with respect to time when in steady state) of a particular IR source (e.g., a window, television) may be considered when determining the steady state time tf and for identifying the IR source. For example, in some embodiments, a particular IR source (e.g., a window) may be identified by a vector direction, vector magnitude, transient time $t_f$, and amount of IR radiation ripple in steady state.

In some embodiments, an IR source may be detected when it is being deactivated. For example, the transition from active to inactive of an IR source (e.g., a ceiling light) may also be detected. In some embodiments, a particular IR source (e.g., a light) may be identified by a vector direction, initial vector magnitude, final vector magnitude, and transient time $t_f$.

In some embodiments, an IR source may move in a predictable manner. For example, a model train may move along the tracks in a predictable path. In some embodiments, a particular IR source (e.g., a model train) may be identified by variations in the vector direction, and vector magnitude.

Other combinations of IR source(s) signatures, such as other combinations of vector (IR source location), vector variations (variations in IR source location), initial vector magnitude (initial IR strength), final vector magnitude (final IR strength), transient time $t_f$(temporal change in IR strength until reaching steady state), time of the day in which the IR source turns on and/or off, amount of IR radiation ripple in steady state, and shape of transient magnitude (shape of the function associated with the temporal change in IR strength until reaching steady state), may also be used.

FIG. 5 shows LUT 500 for storing features of known IR sources, according to an embodiment of the present invention. LUT 108 may be implemented as LUT 500.

As shown in FIG. 5, LUT 500 includes N records, where each record corresponds to a known IR source, or a known combination of known IR sources. In some embodiments, N is higher than or equal to 1, such as 10, 15, 50, or higher. As will be described in more detail later, N may increase over time as the sensing system learns of new known IR sources or known combinations of known IR sources.

As shown in FIG. 5, LUT 500 includes a plurality of feature types, such as IR source location (vector), IR source location variation (vector variations with respect to time), initial IR strength (initial vector magnitude), final IR strength (final vector magnitude), transient time $t_f$ (temporal change in IR strength until reaching steady state), transient shape (shape of the function associated with the temporal change in IR strength until reaching steady state), ripple (amount of IR radiation ripple in steady state), time of the day in which the IR source turns on, and time of the day in which the IR source turns off. Each record of LUT 500 includes a set of identifiers (or features) corresponding to the plurality of feature types that identifies a particular IR source or a particular group of IR sources modeled as a single IR source.

Although a vector may include multiple dimensions (e.g., 4, e.g., when using 4 IR sensors), it is understood that, in some embodiments, IR source location refers to the physical location (e.g., in 2D or 3D space) of the IR source. In some embodiments, a (e.g., non-linear) transformation may be used to transfer from a Q-dimensional vector (e.g., where Q is 4 or more) to a q-dimensional vector (where q is less than 4, such as 3 or 2).

In some embodiments, LUT 500 may include less feature types than shown in FIG. 5. For example, in some embodiments, LUT 500 includes only IR source location, final IR strength, and transient time $t_f$. Other combinations are also possible.

In some embodiments, LUT 500 may include more features than shown in FIG. 5. For example, in some embodiments, other features, such as features extracted using neural networks, may also be used.

In some embodiments, a record (row) of LUT 500 may correspond with a single IR source (e.g., a light bulb). In some embodiments, a record of LUT 500 may correspond to the aggregate of two or more IR sources (e.g., 310 and 312). In some embodiments, a record of LUT 500 may correspond to the deactivation of an IR source (e.g., closing the curtains of a window). In some embodiments, a record of LUT 500 may correspond to the deactivation of a plurality of IR sources (e.g., turning off all lights in a room). In some embodiments, a record of LUT 500 may correspond to the simultaneous activation and deactivation of two IR sources, respectively (e.g., the television turns on at the same time as the ceiling light turns off). a record of LUT 500 may correspond to the activation of an IR source after a one or more IR sources in the environment are already in steady state (e.g., turning on the television after all lights in the room are on). Records corresponding to other combination of IR source events are also possible.

IR sources in an, e.g., indoor, environment, may be identified and considered when deciding whether to issue an alarm caused by presence detection. For example, as will be described in more detail layer, in some embodiments, the location, IR radiation strength, and transient time $t_f$ associated with a ceiling light may be identified during a training phase and/or during runtime. When the ceiling light turns on, the IR sensing system initial detects a presence. However, since the detected IR source matches a known IR source (e.g., matches a record in the LUT 500 e.g., based on location, IR strength, and transient time $t_f$), no presence detection alarm is issued.

FIG. 6 shows a flow chart of embodiment method 600 for a context-aware presence detection, according to an embodiment of the present invention. Controller 104 may implement method 600. Method 600 may be performed during runtime (when the IR sensing system is actively monitoring for presence detection).

During step 602, a presence detection system, such as IR sensing system 100 or 200, is used to detect IR sources, e.g., in an indoor environment. For example, in some embodiments, an IR source is detected based on the output signal (e.g., output voltage) of one or more IR sensors (e.g., 102). For example, in some embodiments, the presence of one or more IR sources is detected when the IR energy measured by each of the IR sensors (e.g., as indicated by the respective output signal) is higher than a predetermined threshold. In some embodiments, an IR source is detected when the IR source is detected for longer than a predetermined amount of time. In some embodiment, an IR source is detected when the IR source moves along a predetermine path. Other presence detection methods may also be used. For example, in some embodiments, presence detection during step 602 may be carried out using any known presence detection algorithm.

In some embodiments, the detected IR source may be the single IR source representation of a plurality of IR sources.

When an IR source is detected, a candidate alarm is issued during step 604. For example, in some embodiments, a candidate alarm may be issued by asserting a bit in a register, or by asserting an internal signal of a controller (e.g., 104).

When a candidate alarm is issued, the detected IR source is compared, during step 606, with known IR sources in the environment. For example, in some embodiments, the detected IR source may be compared with signatures (e.g., a set of identifiers) of known IR sources. In some embodiments, the set of identifiers is stored in a LUT (e.g., 108, 500). In some embodiments, the set of identifiers is stored in a database. Other storage mechanisms may also be used.

As a non-limiting example, the set of identifiers may include location, initial IR strength, final IR strength, and transient time $t_f$. When the candidate alarm is issued by an IR source having a location, initial IR strength, final IR strength, and transient time $t_f$ that matches a location, initial strength, final strength, and transient time $t_f$ of a record stored in the LUT, then, the detected IR source is classified as a known IR source and the candidate alarm is cancelled (e.g., step 608) without issuing a user alarm. If the detected IR source does not match any of the known IR sources, a user alarm is issued during step 610.

In some embodiments, issuing a user alarm (step 610) includes activating a sound, reporting an alert in a smartphone app, activating a light, placing a phone call, and/or any other method to alert a user of a presence of an unknown (foreign) IR source.

In some embodiments, cancelling the candidate alarm (step 608) includes deasserting a register bit or an (e.g., interrupt) internal signal of the controller.

In some embodiments, determining (e.g., during step 606) whether an IR source is known is performed, e.g., using template matching (e.g., by using a correlation metric) between the detected IR source and the known IR sources stored in the LUT. Other pattern recognition models, such as statistical models, syntactic or structural models, and models based on neural networks, may also be used to determine whether an IR source is known.

Figure 7:
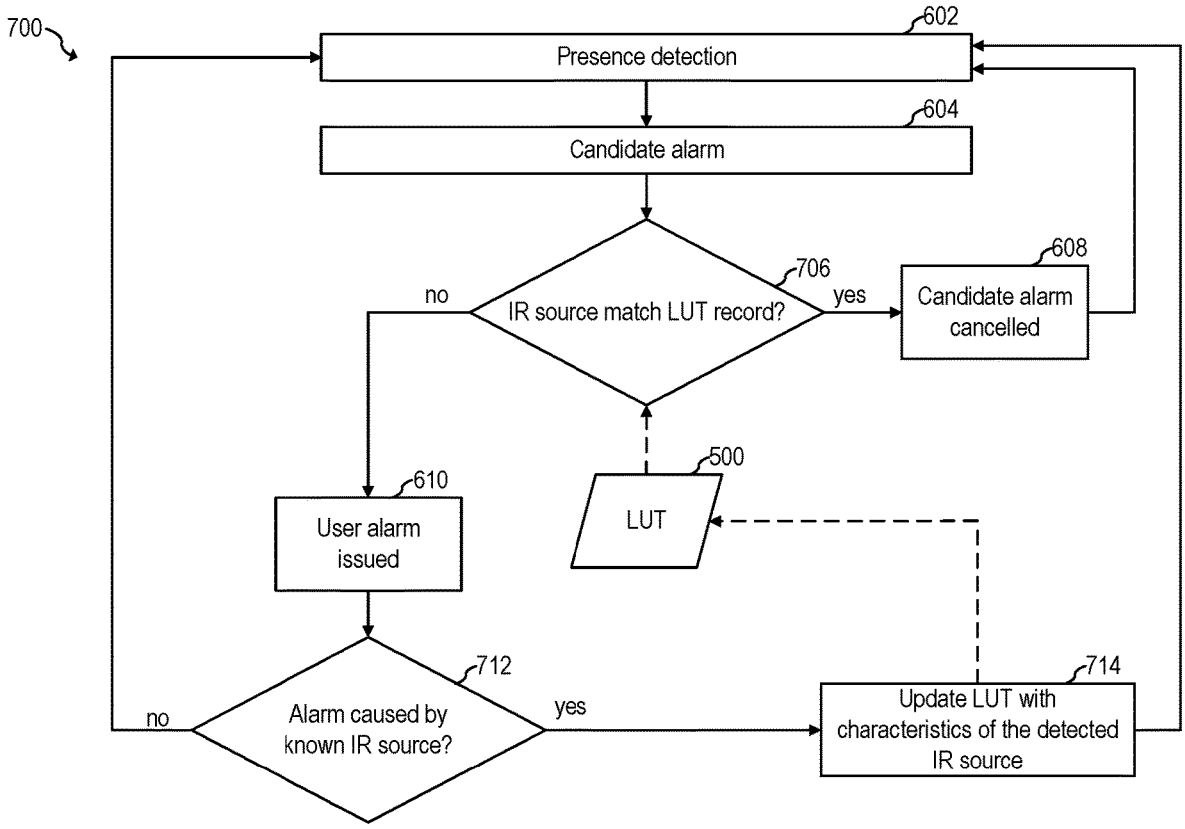
FIG. 7 shows a flow chart of an embodiment method for identifying IR sources that are part of an indoor environment, according to an embodiment of the present invention.

In some embodiments, learning which IR source(s) is part of an indoor environment is performed by populating a LUT (e.g., 108, 500) based on feedback from a user. For example, FIG. 7 shows a flow chart of embodiment method 700 for identifying IR sources that are part of an indoor environment, according to an embodiment of the present invention. Controller 104 may implement method 700. Method 700 includes steps 602, 604, 608, 610, 706, 712, and 714. Steps 603, 604, 608, and 610 may be performed in a similar manner as in method 600. Step 606 may be performed as step 706. Method 700 may be understood as a form of supervised learning.

As shown in FIG. 7, when a candidate alarm is issued, the detected IR source is checked against records of a LUT (e.g., 108, 500) during step 706. If a match is found between the detected IR source and a record of the LUT, then the candidate alarm is cancelled. If a match between the detected IR source and a record of the LUT is not found during step 706, then a user alarm is issued during step 610 and a determination of whether the detected IR source is part of the indoor environment is made during step 712.

In some embodiments, determining a match between the detected IR source and a record of the LUT during step 706 includes matching each of the identifiers of the detected IR source with corresponding identifiers of the set of identifiers of a record in the LUT. In some embodiments, a match is found when each of the identifiers of the detected IR source is substantially equal to the corresponding identifier of the record in the LUT (e.g., within a first set of respective tolerances). In some embodiments, an identifier is substantially equal another identifier when it is within a tolerance, such as 5%. For example, if the transient time $t_f$ of a record is 1 second, a match is found with respect to the detected IR source if the transient time tf of the detected IR source is within the predetermined tolerance (e.g., within 5%) of 1 second. Tolerances different than 5%, such as higher than 5% (e.g., 7% or higher), or lower than 5% (e.g., 1% or lower) are also possible. In some embodiments, the tolerance of each feature type may be different. In some embodiments, the tolerance of each feature type may be the same. Other implementations are also possible.

In some embodiments, determining whether the detected IR source is part of the indoor environment during step 712 includes asking a user (e.g., via a smartphone app) whether the user alarm is a false possible. If the user replies affirmatively, then the LUT is updated to include a new record with characteristics of the detected IR source during step 714.

In some embodiments, method 700 may be performed during runtime. Thus, the number of records N of the LUT (e.g., 500) may change (e.g., increase) as time passes. Thus, some embodiments advantageously learn and adapt to changes in the indoor environment as time passes. Additional advantages of some embodiments include populating the LUT (e.g., 500) with records of IR sources and combination of IR sources that are more likely to be used, thus, advantageously reducing memory consumption without impacting or substantially impacting performance.

In some embodiments, method 700 may be performed during a training phase. For example, in some embodiments, a user may be asked during a training phase to perform normal activities in the indoor environment during the training phase (e.g., operate a television, turn on/off one or more lights or a heater, open/close curtains of a window, etc.). Thus, the LUT (e.g., 500) may be populated during the training phase to include the IR sources and combination of IR sources that are typically used in the indoor environment. By performing method 700 during a training phase, some embodiments advantageously provide a presence detection system that avoids false positives for at least commonly used IR sources that are part of the environment from the beginning of runtime.

In some embodiments, the training phase may be performed when the IR system is initially installed in a new environment. In some embodiments, the training phase may be performed upon request from a user.

In some embodiments, such as in some embodiments in which method 700 is performed during the training phase, steps 610, and 712 may be omitted (e.g., the issuing of the user alarm during step 610 may be masked) and step 714 may be performed each time a new detected IR source is not in the LUT (e.g., each time step 706 outputs "no").

In some embodiments, method 700 may be performed during a training phase and during runtime. By performing method 700 in a training phase and during runtime, some embodiments are advantageously capable of adapting to changes in the indoor environment as time passes while avoiding false positives for at least commonly used IR sources that are part of the environment from the beginning of runtime.

Figure 8:
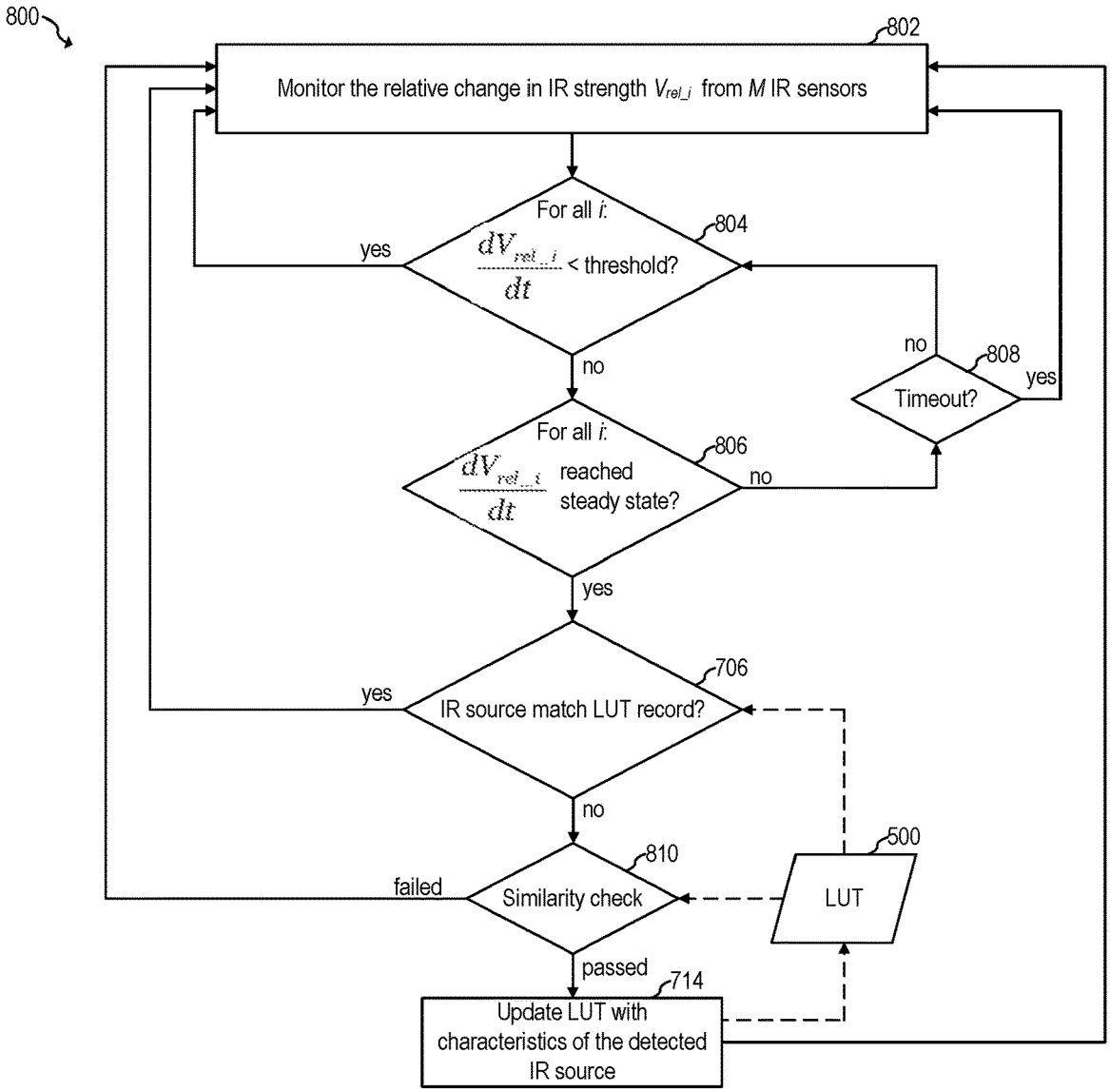
FIG. 8 shows a flow chart of an embodiment method for updating a LUT that includes records of IR sources that are part of an environment, according to an embodiment of the present invention.

In some embodiments, the LUT (e.g., 500) may be populated without user intervention. For example, FIG. 8 shows a flow chart of embodiment method 800 for updating LUT 500, according to an embodiment of the present invention. Controller 104 may implement method 800. Method 800 includes steps 706, 714, 802, 804, 806, 808, and 810. Steps 706 and 714 may be performed in a similar manner as in method 700. In some embodiments, step 602 may be performed by steps 802 and 804. Method 800 may be understood as a form of background learning.

During step 802, the relative change in IR strength $V_{rel}$ with respect to time, from each of M IR sensors (e.g., 102), is monitored. In some embodiments, the relative IR strength $V_{rel}$ measured by an IR sensor may be given by $$V_{rel}=V_{abs}-V_{baseline} \quad (1)$$

where $V_{abs}$ represents the actual IR strength measured by the IR sensor and $V_{baseline}$ represents a baseline IR strength, such as the ambient IR strength.

In some embodiments, M may be a subset of the plurality of IR sensors 102 of an IR sensing system (e.g., 100 or 200). For example, in some embodiments in which the IR sensing system has L IR sensors, M may be between greater than or include to 1 and lower than or equal to L.

During step 804, the relative change in IR strength from each of the M IR sensors is compared with a predetermined threshold. For example, when the relative change in IR strength with respect to time (e.g., relative gradient) from all of the M IR sensors is higher than the threshold, then, during step 706, a detected IR source associated with the IR measurements from the M IR sensors is checked against records of a LUT (e.g., 500) to determine whether the LUT already includes the detected IR source.

As illustrated by steps 806 and 808, in some embodiments, the detected IR source only reaches step 706 if the relative change in IR strength from each of the M IR sensors reaches steady state (e.g., becomes lower than a threshold, such as the same threshold used during step 804) within a predetermined amount of time.

In some embodiments, the predetermine amount of time (for step 808) may be between 5 second and 25 seconds, such as 10 seconds. Longer times, such as 30 seconds, 1 minute, or longer, or shorter times, such as 2 s, or lower, may also be used.

When a match between identifiers of the detected IR source and identifiers of records of the LUT is not found during step 706 (when step 706 outputs "no"), a similarity check is performed during step 810.

During step 810, identifiers of the detected IR source are compared to corresponding identifiers of the records of the LUT to determine whether the detected IR source matches any record or (e.g., aggregated) group of records of the LUT. For example, in some embodiments, template matching is used between characteristics (identifiers) of the detected IR source and corresponding characteristics (identifiers) of a record (or aggregation of records) of the LUT to determine whether the detected IR source is similar to record or records of the LUT.

In some embodiments, step 810 outputs "pass" when the identifiers of the detected IR source matches corresponding identifiers of one record of the LUT or of one aggregated group of records of the LUT.

In some embodiments, determining, during step 810, whether identifiers of the detected IR match identifiers of a record of the LUT includes determining whether (e.g., all) identifiers of the detected IR are substantially equal to identifiers of a record of the LUT, e.g., in a similar manner than performed during step 706 but within a second set of tolerances. In some embodiments, the first set of tolerances (e.g., used during step 706) is tighter than the second set of tolerance (e.g., used during step 810). Thus, in some embodiments, no match may be found between identifiers of a particular IR source and a particular record during step 706, and a match may be found between identifiers of the same particular IR source and the same particular record. For example, if the first transient time tolerance (e.g., applied during step 706) is 5%, the second transient time tolerance (e.g., applied during step 810) is 10%, and the transient time $t_f$ of the detected IR source is 7% longer than the transient time $t_f$ of a particular record of the LUT, then a match is not found between the transient time of detected IR source and the transient time of the particular record during step 706, but a match is found between the transient time of detected IR source and the transient time of the particular record during step 810.

In some embodiments, determining, during step 810, whether identifiers of the detected IR source match aggregated identifiers of an aggregated record of the LUT includes determining whether (e.g., all) identifiers of the detected IR source are substantially equal to aggregated identifiers of an aggregated record of the LUT, e.g., in a similar manner than performed during step 706 but within a third set of tolerances. For example, if the detected IR source has a final IR strength vector of (3,5,3), and if a first record of the LUT includes a first final IR strength vector of (2,2,2), and a second record of the LUT includes a second final IR strength vector of (1,3,1), then a match may be found between the final IR strength identifier of the detected IR source and the aggregate final IR strength identifier of the first and second records (since aggregating (2,2,2) and (1,3,1) results in (3,5,3)).

In some embodiments, the third set of tolerances and the first set of tolerances may be identical. In some embodiments, each of the first tolerances of the set of first tolerances is tighter than the corresponding second tolerances of the second set of tolerances. Other implementations are also possible.

In some embodiments, finding a match between identifiers of the detected IR source and aggregated identifiers of an aggregated record includes finding a match between some, but not all of the aggregated identifiers of the aggregated record.

In some embodiments, the tolerance may be feature dependent. For example, in some embodiments, the magnitude of the tolerance for IR source location may be lower than the magnitude of the tolerance for transient time $t_f$. Thus, the first (or second or third) set of tolerances may include different tolerances for each identifier.

In some embodiments, one or more characteristics of a record, such as one, or a combination, or all of, IR source location (vector), IR source location variation (vector variations with respect to time), initial IR strength (initial vector magnitude), final IR strength (final vector magnitude), transient time $t_f$ (temporal change in IR strength until reaching steady state), transient shape (shape of the function associated with the temporal change in IR strength until reaching steady state), ripple (amount of IR radiation ripple in steady state), time of the day in which the IR source turns on, and time of the day in which the IR source turns off, may be used when performing the similarity check during step 810.

In some embodiments, different sets of characteristics may be used when determining matching during steps 706 and 810.

In some embodiments, during step 810, the signature patterns (e.g., the records of the LUT) are normalized before making the similarity check. For example, in some embodiments, the records are normalized with respect to the IR sensor outputs to account for variations between IR sensor outputs, e.g., caused during manufacturing, and/or environmental conditions.

In some embodiments, template matching may be used for determining a match during step 810. Other pattern recognition models, such as statistical models, syntactic or structural models, and models based on neural networks, may also be used to perform the similarity check during step 810.

When step 810 outputs a pass, then the LUT is updated during step 714.

As illustrated by method 800, in some embodiments, a LUT (e.g., 500) may be advantageously trained without user feedback so that it includes IR sources that are part of the environment.

Figure 9:
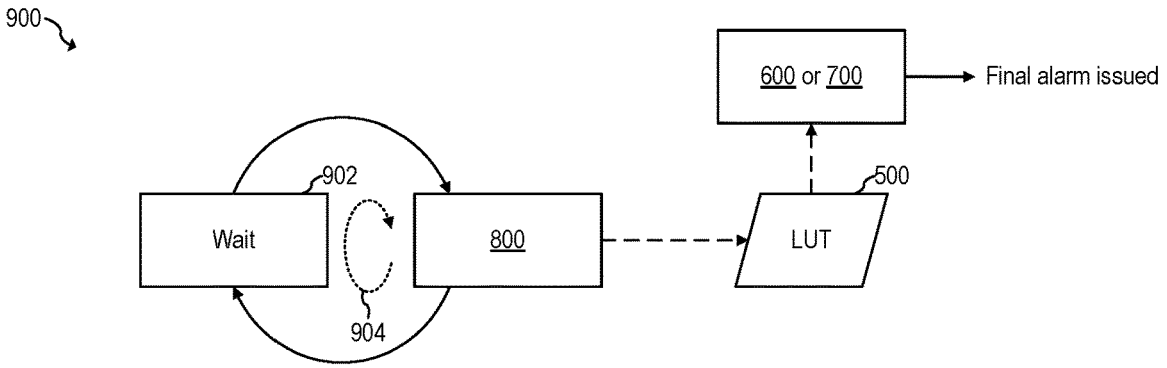
FIG. 9 shows a flow chart of an embodiment method 90 for a context-aware presence detection, according to an embodiment of the present invention.

In some embodiments, method 800 may be performed during runtime. For example, FIG. 9 shows a flow chart of embodiment method 900 for a context-aware presence detection, according to an embodiment of the present invention. Controller 104 may implement method 900.

As shown in FIG. 9, method 800 may be performed at various times during runtime (e.g., in parallel with running a presence detection method, such as method 600 or 700). In some embodiments, method 800 is performed for a predetermined amount of time during each iteration of loop 904. For example, in some embodiments, method 800 is performed for a predetermined duration (e.g., 5 minutes), and the LUT may grow by one record, more than one record, or may not grow depending on how many IR sources are detected and pass step 810 during the predetermined duration.

In some embodiments the predetermined duration may be between 5 minutes, and 15 minutes, such as 10 minutes. Predetermined durations longer than 15 minutes, or shorter than 5 minutes are also possible.

In some embodiments, method 800 is performed until one IR source is detected (e.g., until step 804 outputs "no") during each iteration of loop 904. In some embodiments, method 800 is performed until one IR source is detected or until the predetermined time elapses. Other implementations are also possible.

In some embodiments, method 800 may be performed periodically (at predetermined times or predetermined intervals). For example, in some embodiments, the wait time during step 902 may be fixed. For example, in some embodiments, method 800 may be performed every half an hour. Different intervals, such as longer intervals, (e.g., twice a day, once a week, etc.) and shorter intervals (e.g., every 20 minutes, or shorter), may also be used.

In some embodiments, method 800 may be performed at random times. For example, in some embodiments, the wait time during step 902 may be random. By performing method 800 at random times, some embodiments may advantageously prevent an intruder from intentionally teaching the sensing system (or causing the sensing system to learn) that a particular (e.g., intruding) IR source is part of the environment.

Some embodiments may incorporate additional techniques to improve the performance of presence detection, such as baseline sensitivity tuning (e.g., adjusting the baseline Vbaseline to avoid false positives) adaptive baseline detection (e.g., for incorporating slight variations of IR), and orienting the IR sensors to avoid interfering IR sources (e.g., so that the television is not in the FoV of any of the IR sensors 102).

Advantages of some embodiments include the reduction or elimination of false positives without adjusting the sensitivity of the baseline ($V_{baseline}$), which may advantageously allow for improved sensitivity and detection of foreign IR sources when compared to systems that rely solely on changes in the baseline (e.g., baseline tuning or adaptive baseline) while keeping the complexity of the sensing system low.

Example embodiments of the present invention are summarized here. Other embodiments can also be understood from the entirety of the specification and the claims filed herein.

Example 1. A method including: receiving IR radiation with a plurality of IR sensors having a plurality of respective field-of-views; producing a plurality of output signals with the plurality of IR sensors based on the received IR radiation, where each of the plurality of output signals is indicative of an intensity of the IR radiation received by a respective IR sensor of the plurality of IR sensors; detecting an IR source based on the plurality of output signals; generating a candidate alarm in response to detecting the IR source; determining whether the detected IR source matches any reference IR source of a set of reference IR sources; when the detected IR source matches one reference IR source of the set of reference IR sources, issuing a user alarm; and when the detected IR source does not match any reference IR source of the set of reference IR sources, canceling the candidate alarm without issuing the user alarm.

Example 2. The method of example 1, further including, determining a location of the detected IR source using trilateration based on the plurality of output signals, where determining whether the detected IR source matches any reference IR source includes comparing the location of the detected IR source with a location of a reference IR source of the set of reference IR sources and determining a match when the location of the detected IR source is within a location tolerance of the reference IR source.

Example 3. The method of one of examples 1 or 2, further including, determining a transient time from activation of the detected IR source until the detected IR source reaches steady state based on the plurality of output signals, where determining whether the detected IR source matches any reference IR source includes comparing the transient time of the detected IR source with a transient time of a reference IR source of the set of reference IR sources and determining a match when the transient time of the detected IR source is within a transient time tolerance of the reference IR source.

Example 4. The method of one of examples 1 to 3, further including, determining a steady state IR strength of the detected IR source based on the plurality of output signals, where determining whether the detected IR source matches any reference IR source includes comparing the steady state IR strength of the detected IR source with a steady state IR strength of a reference IR source of the set of reference IR sources and determining a match when the steady state IR strength of the detected IR source is within a steady state IR strength tolerance of the reference IR source.

Example 5. The method of one of examples 1 to 4, where the detected IR source includes a set of identifiers, and where determining whether the detected IR source matches any reference IR source includes: comparing each identifier of the set of identifiers of the detected IR source with a corresponding identifier of a reference IR source of the set of reference IR sources; and finding a match when each identifier of the set of identifiers of the detected IR source is within a respective predetermined tolerance of the corresponding identifier of the reference IR source.

Example 6. The method of one of examples 1 to 5, where the set of identifiers of the detected IR source includes a location of the detected IR source, a transient time of the detected IR source, and steady state IR strength of the detected IR source.

Example 7. The method of one of examples 1 to 6, where determining whether the detected IR source matches any reference IR source includes using template matching based on the set of identifiers of the detected IR source and a corresponding set of identifiers of a reference IR source.

Example 8. The method of one of examples 1 to 7, where a look-up table (LUT) includes the set of reference IR sources, where determining whether the detected IR source matches any reference IR source of the set of reference IR sources includes reading a record from the LUT.

Example 9. The method of one of examples 1 to 8, further including populating the LUT based on user feedback.

Example 10. The method of one of examples 1 to 9, where the plurality of IR sensors includes L IR sensors, L being a positive integer greater than or equal to 3, the method further including autonomously populating the LUT, where autonomously populating the LUT includes: when each relative change, with respect to time, in IR strength from M IR sensors of the plurality of IR sensors is higher than a predetermined threshold, checking whether identifiers of a candidate IR source match corresponding identifiers of any record of the LUT within a first set of respective tolerances, where M is a positive integer lower than or equal to L, and where the candidate IR source is associated with the relative changes in IR strength from the M IR sensors; when the identifiers of the candidate IR source do not match the corresponding identifiers of any record of the LUT within the first set of respective tolerances, checking whether the identifiers of the candidate IR source match corresponding identifiers of any record of the LUT within a second set of respective tolerances, and checking whether the identifiers of the candidate IR source match corresponding aggregated identifiers of aggregated records of the LUT within a third set of respective tolerances; and when the identifiers of the candidate IR source match corresponding identifiers of a first record of the LUT within the second set of respective tolerances or when the identifiers of the candidate IR source match corresponding aggregated identifiers of a first aggregated record of the LUT within the third set of respective tolerances, adding a record to the LUT with a set of identifiers corresponding to the candidate IR source.

Example 11. The Method of One of Examples 1 to 10, where Autonomously Populating the LUT further includes: waiting for each relative change with respect to time in IR strength from the M IR sensors to become lower than the predetermined threshold before checking whether identifiers of the candidate IR source matches corresponding identifiers of any record of the LUT within the first set of respective tolerances.

Example 12. The method of one of examples 1 to 11, where each first tolerance of the first set of respective tolerances is tighter than a corresponding second tolerance of the second set of respective tolerances.

Example 13. The method of one of examples 1 to 12, further including autonomously populating the LUT at periodic times.

Example 14. The method of one of examples 1 to 13, further including autonomously populating the LUT at random times.

Example 15. The method of one of examples 1 to 14, where each of the plurality of respective field-of-views at least partially overlap with each other of the plurality of respective field-of-views.

Example 16. The method of one of examples 1 to 15, where the IR source includes more than one object emitting IR radiation in more than one location in the plurality of field-of-views.

Example 17. The method of one of examples 1 to 16, where each IR sensor of the plurality of IR sensors includes a thermopile.

Example 18. The method of one of examples 1 to 17, where each output signal of the plurality of output signals is an output voltage.

Example 19. The method of one of examples 1 to 18, where issuing the user alarm includes alerting a user by activating a sound, reporting an alert in a smartphone app, activating a light, or placing a phone call.

Example 20. The method of one of examples 1 to 19, where issuing the candidate alarm includes asserting a bit or interrupt signal, and where canceling the candidate alarm includes deasserting the bit or interrupt signal.

Example 21. An infrared (IR) sensing system including: a plurality of IR sensors having a plurality of respective field-of-views, each IR sensor of the plurality of IR sensors configured to produce a respective output signal based on IR radiation received from the respective field-of-view; and a controller configured to: detect an IR source based on one or more output signals of the plurality of IR sensors, generate a candidate alarm in response to detecting the IR source, determine whether the detected IR source matches any reference IR source of a set of reference IR sources, when the detected IR source matches one reference IR source of the set of reference IR sources, issue a user alarm, and when the detected IR source does not match any reference IR source of the set of reference IR sources, cancel the candidate alarm without issuing the user alarm.

Example 22. The IR sensing system of example 21, where a first IR sensor of the plurality of IR sensors includes the controller.

Example 23. The IR sensing system of one of examples 21 or 22, further including a microcontroller including the controller, the microcontroller being external to the plurality of IR sensors.

Example 24. The IR sensing system of one of examples 21 to 23, where the controller is configured to wirelessly receive data from the plurality of IR sensors, the received data being indicative of the respective output signals of the plurality of IR sensors.

Example 25. The IR sensing system of one of examples 21 to 24, where each IR sensor of the plurality of IR sensors includes a thermopile.

Example 26. A method including: receiving IR radiation with a plurality of IR sensors having a plurality of respective field-of-views; producing a plurality of output signals based on the received IR radiation, where each of the plurality of output signals is indicative of an intensity of the IR radiation received by a respective IR sensor of the plurality of IR sensors; detecting a candidate IR source based on the plurality of output signals when each relative change with, respect to time, in IR strength from the plurality of IR sensors is higher than a predetermined threshold; after detecting the candidate IR source, checking whether identifiers of the candidate IR source match corresponding identifiers of any record of a look-up table (LUT) within a first set of respective tolerances; when the identifiers of the candidate IR source do not match the corresponding identifiers of any record of the LUT within the first set of respective tolerances, checking whether the identifiers of the candidate IR source match corresponding identifiers of any record of the LUT within a second set of respective tolerances, and checking whether the identifiers of the candidate IR source match corresponding aggregated identifiers of aggregated records of the LUT within a third set of respective tolerances; and when the identifiers of the candidate IR source match corresponding identifiers of a first record of the LUT within the second set of respective tolerances or when the identifiers of the candidate IR source match corresponding aggregated identifiers of a first aggregated record of the LUT within the third set of respective tolerances, adding a record to the LUT with a set of identifiers corresponding to the candidate IR source.

Example 27. The method of example 26, further including: detecting a further IR source based on the plurality of output signals; generating a candidate alarm in response to detecting the further IR source; determining whether identifiers of the detected further IR source matches identifiers of a record of the LUT; when a match is found between identifiers of the detected further IR source and identifiers of one record of the LUT, issuing a user alarm; and when a match is not found between identifiers of the detected further IR source and identifiers of any record of the LUT, canceling the candidate alarm without issuing the user alarm.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. A method comprising:

receiving infrared (IR) radiation with a plurality of IR sensors having a plurality of respective field-of-views;

producing a plurality of output signals with the plurality of IR sensors based on the received IR radiation, wherein each of the plurality of output signals is indicative of an intensity of the IR radiation received by a respective IR sensor of the plurality of IR sensors;

detecting an IR source based on the plurality of output signals;

generating a candidate alarm in response to detecting the IR source;

determining whether the detected IR source matches any reference IR source of a set of reference IR sources;

when the detected IR source matches one reference IR source of the set of reference IR sources, issuing a user alarm; and when the detected IR source does not match any reference IR source of the set of reference IR sources, canceling the candidate alarm without issuing the user alarm.

2. The method of claim 1, further comprising, determining a location of the detected IR source using trilateration based on the plurality of output signals, wherein determining whether the detected IR source matches any reference IR source comprises comparing the location of the detected IR source with a location of a reference IR source of the set of reference IR sources and determining a match when the location of the detected IR source is within a location tolerance of the reference IR source.

3. The method of claim 1, further comprising, determining a transient time from activation of the detected IR source until the detected IR source reaches steady state based on the plurality of output signals, wherein determining whether the detected IR source matches any reference IR source comprises comparing the transient time of the detected IR source with a transient time of a reference IR source of the set of reference IR sources and determining a match when the transient time of the detected IR source is within a transient time tolerance of the reference IR source.

4. The method of claim 1, further comprising, determining a steady state IR strength of the detected IR source based on the plurality of output signals, wherein determining whether the detected IR source matches any reference IR source comprises comparing the steady state IR strength of the detected IR source with a steady state IR strength of a reference IR source of the set of reference IR sources and determining a match when the steady state IR strength of the detected IR source is within a steady state IR strength tolerance of the reference IR source.

5. The method of claim 1, wherein the detected IR source comprises a set of identifiers, and wherein determining whether the detected IR source matches any reference IR source comprises:

comparing each identifier of the set of identifiers of the detected IR source with a corresponding identifier of a reference IR source of the set of reference IR sources; and finding a match when each identifier of the set of identifiers of the detected IR source is within a respective predetermined tolerance of the corresponding identifier of the reference IR source.

6. The method of claim 5, wherein the set of identifiers of the detected IR source comprises a location of the detected IR source, a transient time of the detected IR source, and steady state IR strength of the detected IR source.

7. The method of claim 5, wherein determining whether the detected IR source matches any reference IR source comprises using template matching based on the set of identifiers of the detected IR source and a corresponding set of identifiers of a reference IR source.

8. The method of claim 1, wherein a look-up table (LUT) comprises the set of reference IR sources, wherein determining whether the detected IR source matches any reference IR source of the set of reference IR sources comprises reading a record from the LUT.

9. The method of claim 8, further comprising populating the LUT based on user feedback.

10. The method of claim 8, wherein the plurality of IR sensors comprises L IR sensors, L being a positive integer greater than or equal to 3, the method further comprising autonomously populating the LUT, wherein autonomously populating the LUT comprises:

when each relative change, with respect to time, in IR strength from M IR sensors of the plurality of IR sensors is higher than a predetermined threshold, checking whether identifiers of a candidate IR source match corresponding identifiers of any record of the LUT within a first set of respective tolerances, wherein M is a positive integer lower than or equal to L, and wherein the candidate IR source is associated with the relative changes in IR strength from the M IR sensors;

when the identifiers of the candidate IR source do not match the corresponding identifiers of any record of the LUT within the first set of respective tolerances, checking whether the identifiers of the candidate IR source match corresponding identifiers of any record of the LUT within a second set of respective tolerances, and checking whether the identifiers of the candidate IR source match corresponding aggregated identifiers of aggregated records of the LUT within a third set of respective tolerances; and when the identifiers of the candidate IR source match corresponding identifiers of a first record of the LUT within the second set of respective tolerances or when the identifiers of the candidate IR source match corresponding aggregated identifiers of a first aggregated record of the LUT within the third set of respective tolerances, adding a record to the LUT with a set of identifiers corresponding to the candidate IR source.

11. The method of claim 10, wherein autonomously populating the LUT further comprises: waiting for each relative change with respect to time in IR strength from the M IR sensors to become lower than the predetermined threshold before checking whether identifiers of the candidate IR source matches corresponding identifiers of any record of the LUT within the first set of respective tolerances.

12. The method of claim 10, wherein each first tolerance of the first set of respective tolerances is tighter than a corresponding second tolerance of the second set of respective tolerances.

13. The method of claim 10, further comprising autonomously populating the LUT at periodic times.

14. The method of claim 10, further comprising autonomously populating the LUT at random times.

15. The method of claim 1, wherein each of the plurality of respective field-of-views at least partially overlap with each other of the plurality of respective field-of-views.

16. The method of claim 1, wherein the IR source comprises more than one object emitting IR radiation in more than one location in the plurality of field-of-views.

17. The method of claim 1, wherein each IR sensor of the plurality of IR sensors comprises a thermopile.

18. The method of claim 1, wherein each output signal of the plurality of output signals is an output voltage.

19. The method of claim 1, wherein issuing the user alarm comprises alerting a user by activating a sound, reporting an alert in a smartphone app, activating a light, or placing a phone call.

20. The method of claim 1, wherein issuing the candidate alarm comprises asserting a bit or interrupt signal, and wherein canceling the candidate alarm comprises deasserting the bit or interrupt signal.

21. An infrared (IR) sensing system comprising:

a plurality of IR sensors having a plurality of respective field-of-views, each IR sensor of the plurality of IR sensors configured to produce a respective output signal based on IR radiation received from the respective field-of-view; and a controller configured to:

detect an IR source based on one or more output signals of the plurality of IR sensors, generate a candidate alarm in response to detecting the IR source, determine whether the detected IR source matches any reference IR source of a set of reference IR sources, when the detected IR source matches one reference IR source of the set of reference IR sources, issue a user alarm, and when the detected IR source does not match any reference IR source of the set of reference IR sources, cancel the candidate alarm without issuing the user alarm.

22. The IR sensing system of claim 21, wherein a first IR sensor of the plurality of IR sensors comprises the controller.

23. The IR sensing system of claim 21, further comprising a microcontroller comprising the controller, the microcontroller being external to the plurality of IR sensors.

24. The IR sensing system of claim 21, wherein the controller is configured to wirelessly receive data from the plurality of IR sensors, the received data being indicative of the respective output signals of the plurality of IR sensors.

25. The IR sensing system of claim 21, wherein each IR sensor of the plurality of IR sensors comprises a thermopile.

26. A method comprising:

receiving infrared (IR) radiation with a plurality of IR sensors having a plurality of respective field-of-views;

producing a plurality of output signals based on the received IR radiation, wherein each of the plurality of output signals is indicative of an intensity of the IR radiation received by a respective IR sensor of the plurality of IR sensors;

detecting a candidate IR source based on the plurality of output signals when each relative change with, respect to time, in IR strength from the plurality of IR sensors is higher than a predetermined threshold;

after detecting the candidate IR source, checking whether identifiers of the candidate IR source match corresponding identifiers of any record of a look-up table (LUT) within a first set of respective tolerances;

when the identifiers of the candidate IR source do not match the corresponding identifiers of any record of the LUT within the first set of respective tolerances, checking whether the identifiers of the candidate IR source match corresponding identifiers of any record of the LUT within a second set of respective tolerances, and checking whether the identifiers of the candidate IR source match corresponding aggregated identifiers of aggregated records of the LUT within a third set of respective tolerances; and when the identifiers of the candidate IR source match corresponding identifiers of a first record of the LUT within the second set of respective tolerances or when the identifiers of the candidate IR source match corresponding aggregated identifiers of a first aggregated record of the LUT within the third set of respective tolerances, adding a record to the LUT with a set of identifiers corresponding to the candidate IR source.

27. The method of claim 26, further comprising:

detecting a further IR source based on the plurality of output signals;

generating a candidate alarm in response to detecting the further IR source;

determining whether identifiers of the detected further IR source matches identifiers of a record of the LUT;

when a match is found between identifiers of the detected further IR source and identifiers of one record of the LUT, issuing a user alarm; and when a match is not found between identifiers of the detected further IR source and identifiers of any record of the LUT, canceling the candidate alarm without issuing the user alarm.

* * * * *